US005699836A

United States Patent [19]

Golz

[11] Patent Number: 5,699,836

[45] Date of Patent: Dec. 23, 1997

[54] METHOD AND APPARATUS FOR MANUFACTURING SLOTTED WEBBING ON A NEEDLE LOOM

[75] Inventor: Robert E. Golz, Swansea, Mass.

[73] Assignee: Murdock Webbing Company, Inc., Central Falls, R.I.

[21] Appl. No.: 661,318

[22] Filed: Jun. 13, 1996

[51] Int. Cl.[6] ..... D03D 35/00; D03D 47/06

[52] U.S. Cl. ..... 139/22; 139/93

[58] Field of Search ..... 139/93, 22, 446, 139/390, 384 A, 20

[56] References Cited

U.S. PATENT DOCUMENTS

| | | | |
|---|---|---|---|
| 2,355,532 | 8/1944 | Holmes | 139/22 |
| 3,857,418 | 12/1974 | Kida et al. | 139/20 |
| 3,951,178 | 4/1976 | Simmons, Jr. | 139/446 |
| 4,046,170 | 9/1977 | Juillard et al. | 139/20 |
| 4,342,339 | 8/1982 | Koch | 139/93 |
| 5,348,055 | 9/1994 | Kramer | 139/93 |

FOREIGN PATENT DOCUMENTS

| | | | |
|---|---|---|---|
| 2 238 800 | 6/1991 | United Kingdom | 139/394 A |

*Primary Examiner*—Andy Falik
*Attorney, Agent, or Firm*—Salter & Michaelson

[57] ABSTRACT

A method of manufacturing slotted webbing of the type having slotted portions selectively formed between solid portions includes the steps of providing a needle loom machine, selectively positioning warp yarns with the needle loom machine between a first position in which there is a single shed opening provided through the yarns and a second position in which there are two shed openings provided through the yarns, and inserting weft yarns with the needle loom machine to weave the warp yarns with the weft yarns. The arrangement is such that when the warp yarns are in their first position, the solid portion of the webbing is fabricated and when the warp arms are in their second position, the slotted portion of the webbing is fabricated. A modified heddle of the present invention associated with the second position is further disclosed.

6 Claims, 8 Drawing Sheets

| PICKS | 12 | 11 | 10 | 9 | 8 | 7 | 6 | 5 | 4 | 3 | 2 | 1 |
|---|---|---|---|---|---|---|---|---|---|---|---|---|
| 20 | | | X | | X | X | | X | | X | | X |
| 19 | X | X | | | X | | | X | | X | | X |
| 18 | X | | X | X | | | | X | | X | | X |
| 17 | | | X | | X | X | | X | | X | | X |
| 16 | X | X | | | X | | | X | | X | | X |
| 15 | X | | X | X | | | | X | | X | | X |
| 14 | | | X | | X | X | | X | | X | | X |
| 13 | X | X | | | X | | | X | | X | | X |
| 12 | X | | X | X | | | | X | | X | | X |
| 11 | | | X | | X | X | | X | | X | | X |
| 10 | X | X | | | X | | X | X | | X | | |
| 9 | X | | X | X | | | X | | X | X | | |
| 8 | X | | X | | X | | X | | X | | X | |
| 7 | X | | X | | X | | X | | X | | X | |
| 6 | | | X | | X | X | | | X | | X | X |
| 5 | X | X | | | X | | | X | | | X | X |
| 4 | X | | X | X | | | | X | | X | | X |
| 3 | | | X | | X | X | | X | | X | | X |
| 2 | X | X | | | X | | | X | | X | | X |
| 1 | X | | X | X | | | | X | | X | | X |

HEDDLES

X=HEDDLES UP

FIG. 10

| PICKS | 12 | 11 | 10 | 9 | 8 | 7 | 6 | 5 | 4 | 3 | 2 | 1 |
|---|---|---|---|---|---|---|---|---|---|---|---|---|
| 82 | | | X | X | X | X | | | X | X | X | X |
| 81 | X | X | | | X | | X | X | | | X | |
| 80 | X | | X | X | | | X | | X | X | | |
| 79 | X | | X | | X | | X | | X | | X | |
| 78 | X | | X | | X | | X | | X | | X | |
| 77 | | | X | | X | X | | | X | | X | X |
| 76 | X | X | | | X | | X | X | | | X | |
| 75 | X | | X | X | | | X | | X | X | | |
| 74 | X | | X | | X | | X | | X | | X | |
| 73 | X | | X | | X | | X | | X | | X | |
| 72 | | | X | | X | X | | | X | | X | X |
| 71 | X | X | | | X | | X | X | | | X | |
| 70 | X | | X | X | | | X | | X | X | | |
| 69 | X | | X | | X | | X | | X | | X | |
| 68 | X | | X | | X | | X | | X | | X | |
| 67 | | | X | | X | X | | | X | | X | X |
| 66 | X | X | | | X | | X | X | | | X | |
| 65 | X | | X | X | | | X | | X | X | | |
| 64 | X | | X | | X | | X | | X | | X | |
| 63 | X | | X | | X | | X | | X | | X | |
| 62 | | | X | | X | X | | | X | | X | X |
| 61 | X | X | | | X | | X | X | | | X | |
| 60 | X | | X | X | | | X | | X | X | | |
| 59 | X | | X | | X | | X | | X | | X | |
| 58 | X | | X | | X | | X | | X | | X | |
| 57 | | | X | | X | X | | | X | | X | X |
| 56 | X | X | | | X | | X | X | | | X | |
| 55 | X | | X | X | | | X | | X | X | | |
| 54 | X | | X | | X | | X | | X | | X | |
| 53 | X | | X | | X | | X | | X | | X | |
| 52 | | | X | | X | X | | | X | | X | X |
| 51 | X | X | | | X | | X | X | | | X | |
| 50 | X | | X | X | | | X | | X | X | | |
| 49 | X | | X | | X | | X | | X | | X | |
| 48 | X | | X | | X | | X | | X | | X | |
| 47 | | | X | | X | X | | | X | | X | X |
| 46 | X | X | | | X | | X | X | | | X | |
| 45 | X | | X | X | | | X | | X | X | | |
| 44 | X | | X | | X | | X | | X | | X | |
| 43 | X | | X | | X | | X | | X | | X | |
| 42 | | | X | | X | X | | | X | | X | X |
| 41 | X | X | | | X | | | X | | | X | X |
| 40 | X | | X | X | X | | | X | | X | | X |
| 39 | | | X | | | X | | X | | X | | X |
| 38 | X | X | | | X | | | X | | X | | X |
| 37 | X | | X | X | | | | X | | X | | X |
| 36 | | | X | | X | X | | X | | X | | X |
| 35 | X | X | | | X | | | X | | X | | X |
| 34 | X | | X | X | | | | X | | X | | X |
| 33 | | | X | | X | X | | X | | X | | X |
| 32 | X | X | | | X | | | X | | X | | X |
| 31 | X | | X | X | | | | X | | X | | X |
| 30 | | | X | | X | X | | X | | X | | X |
| 29 | X | X | | | X | | | X | | X | | X |
| 28 | X | | X | X | | | | X | | X | | X |
| 27 | | | X | | X | X | | X | | X | | X |
| 26 | X | X | | | X | | | X | | X | | X |
| 25 | X | | X | X | | | | X | | X | | X |
| 24 | | | X | | X | X | | X | | X | | X |
| 23 | X | X | | | X | | | X | | X | | X |
| 22 | X | | X | X | | | | X | | X | | X |
| 21 | | | X | | X | X | | X | | X | | X |
| 20 | X | X | | | X | | | X | | X | | X |
| 19 | X | | X | X | | | | X | | X | | X |
| 18 | | | X | | X | X | | X | | X | | X |
| 17 | X | X | | | X | | | X | | X | | X |
| 16 | X | | X | X | | | | X | | X | | X |
| 15 | | | X | | X | X | | X | | X | | X |
| 14 | X | X | | | X | | | X | | X | | X |
| 13 | X | | X | X | | | | X | | X | | X |
| 12 | | | X | | X | X | | X | | X | | X |
| 11 | X | X | | | X | | | X | | X | | X |
| 10 | X | | X | X | | | | X | | X | | X |
| 9 | | | X | | X | X | | X | | X | | X |
| 8 | X | X | | | X | | | X | | X | | X |
| 7 | X | | X | X | | | | X | | X | | X |
| 6 | | | X | | X | X | | X | | X | | X |
| 5 | X | X | | | X | | | X | | X | | X |
| 4 | X | | X | X | | | | X | | X | | X |
| 3 | | | X | | X | X | | X | | X | | X |
| 2 | X | X | | | X | | | X | | X | | X |
| 1 | X | | X | X | | | | X | | X | | X |

HEDDLES

X=HEDDLES UP

FIG. 13

METHOD AND APPARATUS FOR MANUFACTURING SLOTTED WEBBING ON A NEEDLE LOOM

BACKGROUND AND SUMMARY OF THE INVENTION

This invention relates generally to methods and apparatuses for manufacturing slotted webbing, and more particularly to a method and apparatus that produces slotted webbing with a needle loom machine, rather than the commonly used shuttle loom machine.

Shuttle looms have been producing narrow fabrics for decades. Most shuttle looms have one shuttle per piece or position at the loom. For example, a twelve space loom would have twelve shuttles. The shuttle is that part of the loom which carries the filling (weft) yarn that traverses from the left side of the loom to the right side, interlacing through the long (warp) yarns to bind these long yarns together. For a double shuttle loom, the long yarns are positioned by harnesses which are capable of moving between three positions—top, middle and bottom positions. Special shuttle looms were developed that have two shuttles per position at the loom. These special looms, because of the double shuttle, can weave what is called slotted or "cargo" webbing.

Until the present invention, all cargo webbing had to be woven on a shuttle loom using two shuttles. To weave the cargo webbing, the loom, as mentioned above, must also have the ability to move the harnesses between top, middle and bottom positions. These three positions are necessary for creating two shed openings of yarn between a top sheet of yarn, a middle sheet of yarn and a bottom sheet of yarn. The top shed opening allows the top shuttle to pass under the top sheet of yarn and above the middle sheet of yarn. The bottom shed opening allows the bottom shuttle to pass under the middle sheet of yarn and over the bottom sheet of yarn. This movement produces the slot portion of the cargo webbing. When the solid portion of the webbing is woven, the loom is programmed to have only two harness positions—a top position and a bottom position. This creates only one shed opening that allows both shuttles to pass through thereby creating the solid portion of the cargo webbing.

A significant disadvantage with a shuttle loom is its slow speed. Needle looms were developed to overcome this disadvantage. Needle looms comprise harnesses capable of moving between only two positions—a top position and a bottom position. The needle loom can insert two filling (weft) yarns at the same time with the use of a double needle. However, needle loom manufacturers have not developed a needle loom that is capable of moving its harnesses between three positions as with the shuttle looms. Without being able to move the harnesses between three positions, the needle loom cannot fabricate cargo webbing, but is limited to producing two separate (i.e., not attached) webbings, one on top of the other.

Accordingly, among the several objects of the present invention is the provision of an improved method and apparatus for manufacturing cargo webbing that produces the cargo webbing inexpensively and at a high speed while using a conventional needle loom machine.

The present invention is directed to a method of manufacturing slotted webbing of the type having slotted portions selectively formed (e.g., alternating) between solid portions. The method comprises the steps of: (a) providing a needle loom machine; (b) selectively positioning warp yarns with the needle loom machine between a first position in which there is a single shed opening provided through the yarns and a second position in which there are two shed openings provided through the yarns; and (c) inserting weft yarns with the needle loom machine to weave the warp yarns with the weft yarns. The arrangement is such that when the warp yarns are in their first position, the solid portion of the webbing is fabricated and when the warp arms are in their second position, the slotted portion of the webbing is fabricated.

More Specifically, the needle loom machine comprises a plurality of harnesses each being movable between up and down positions. Each harness has at least one vertically disposed heddle mounted thereon with a small central opening formed therein, the warp yarns of the webbing being received through openings of the heddles. The needle loom machine further comprises a pair of needles each having a weft yarn. The method further comprises the steps of dividing the harnesses into two equal first and second groups, and replacing the heddles of the first group adjacent to the point at which the yarns are woven with heddles each having a vertical slotted opening formed therein.

Also disclosed is an improved needle loom machine with heddles of the present invention for achieving the method described above.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention:

FIG. 10 is a chart illustrating the movement of twelve heddles used to produce the cargo webbing;

FIG. 13 is a chart similar to FIG. 10 illustrating the movement of twelve heddles used to produce the cargo webbing having a different stitch pattern.

Corresponding reference numerals designate corresponding parts throughout the several views of the drawings.

DETAILED DESCRIPTION OF THE PREFERRED EMBODIMENTS

Figure 1:
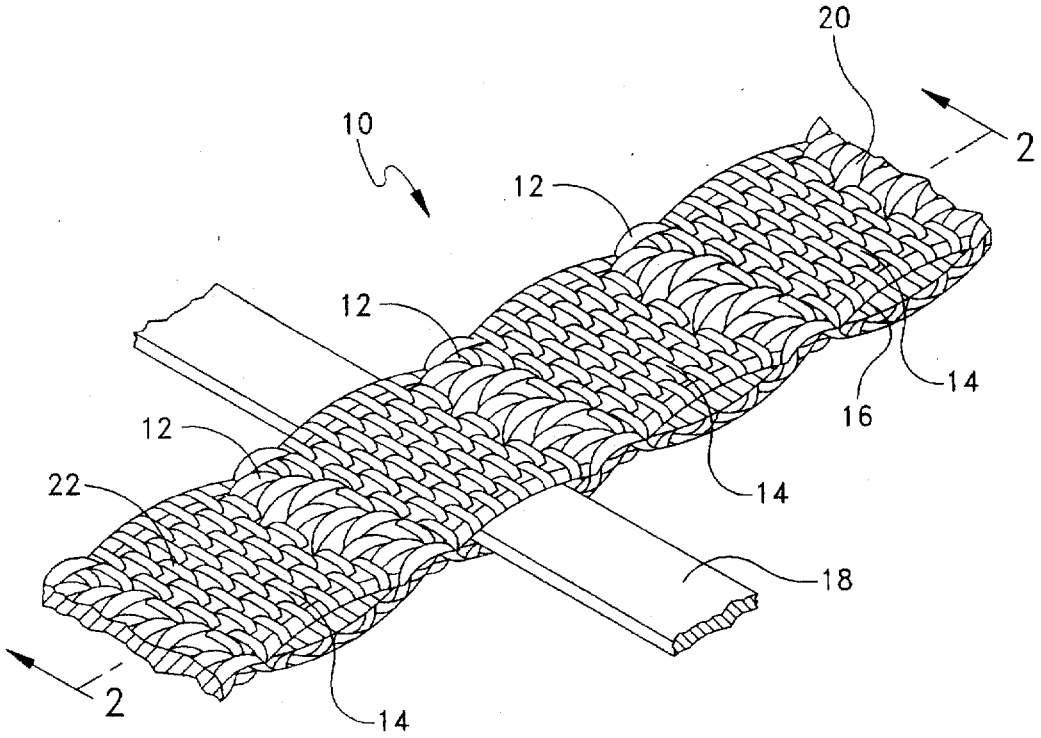
FIG. 1 is a perspective view of a strip of slotted or "cargo" webbing made pursuant to the novel method of the present invention.
Figure 2:
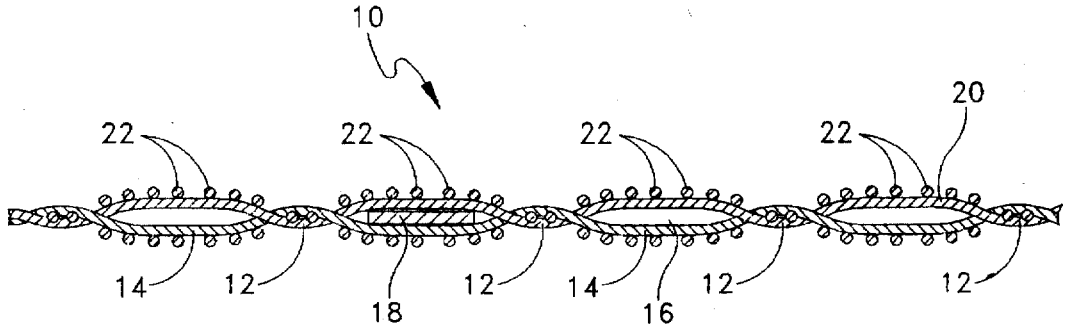
FIG. 2 is a cross-sectional view taken along line 2—2 of FIG. 1.

Referring now to the drawings, and more particularly to FIGS. 1 and 2, there is generally indicated at 10 slotted or "cargo" webbing that is manufactured pursuant to the method and apparatus of the present invention. As shown, the cargo webbing 10 has alternating solid portions 12 and slotted portions 14. Each slotted portion 14 has a slot 16 formed therein (FIG. 2) that extends the width of the cargo webbing 10 as witnessed by the long, thin member 18 illustrated in FIG. 1 extending completely through one of the slots of webbing. The solid and slotted portions 12, 14 are created by weaving long (warp) yarns 20 and cross (weft) filling yarns 22 in a manner to be described in greater detail below. A primary purpose of the cargo webbing 10 is for fabricating cargo nets.

The cargo webbing 10, as described above, can be made with a shuttle loom machine as is well-known in the art of fabric manufacture. However, the novelty of the present invention is that the cargo webbing 10 is manufactured with a needle loom machine, such as a Narrow Fabric Needle Loom NFR(Q), which is sold under the trade name Muller Mutronic by Jakob Muller AG, of Frick, Switzerland. Such a needle loom machine, although not specifically depicted in the drawings, is also well-known in the art of loom machines for their increased rate of operation as compared with the relatively slower shuttle looms.

More specifically, the needle loom machine is of the type having a plurality of harnesses—twenty harnesses with electronic shedding, and six harnesses that run off cams. The harnesses are designated 24 in FIG. 9 and are schematically illustrated therein in broken lines. The harnesses 24 can be programmed to move between only two positions for weaving webbing, namely, an up position, and a down position. The harnesses 24 can be further programmed to move up and down certain distances. It should be pointed out that a person having ordinary skill in the art is capable of programming the needle loom machine so as to control the movement of the harnesses 24 for achieving the purposes of the present invention.

Figure 3:
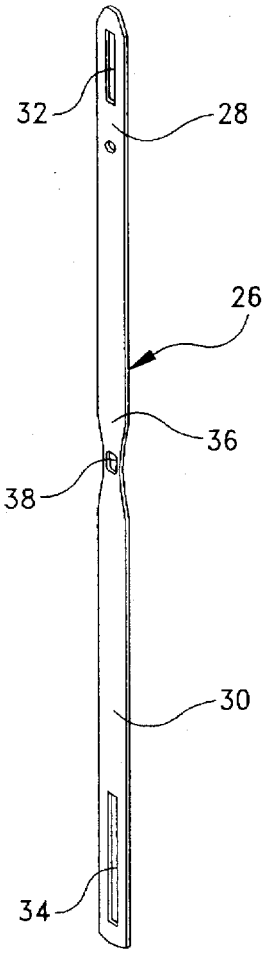
FIG. 3 is a perspective view of a heddle of standard construction, the heddle being used in a narrow fabric needle loom machine provided to perform the method.
Figure 4:
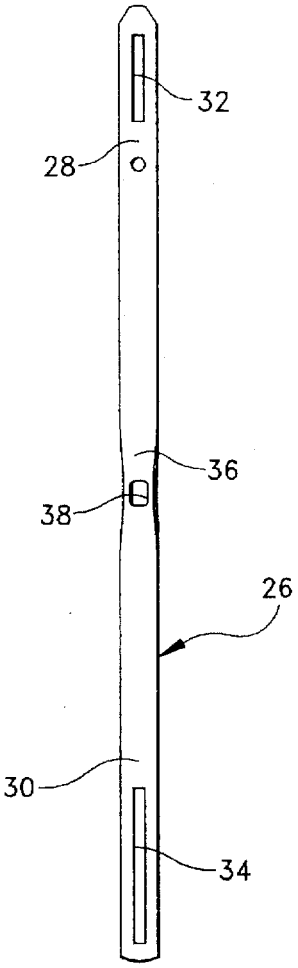
FIG. 4 is a front elevational view thereof.
Figure 5:
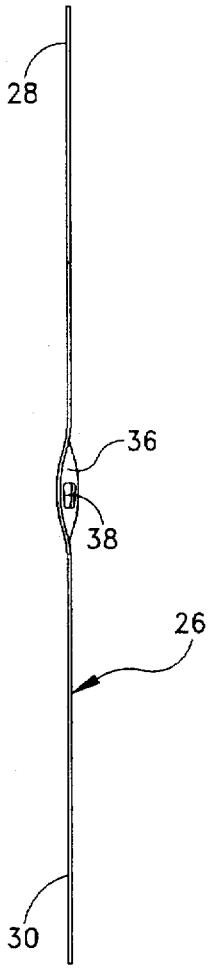
FIG. 5 is a side elevational view thereof.
Figure 6:
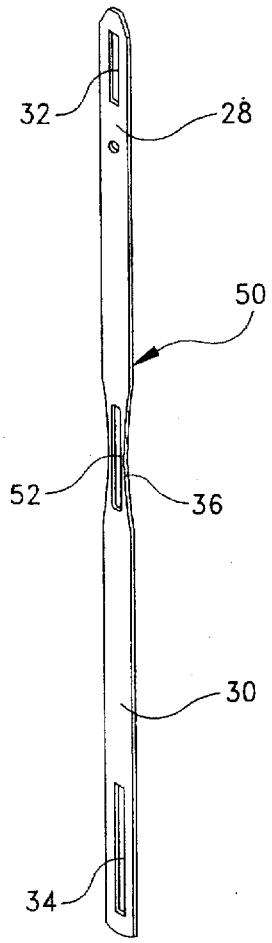
FIG. 6 is a perspective view of a modified heddle of the present invention.
Figure 7:
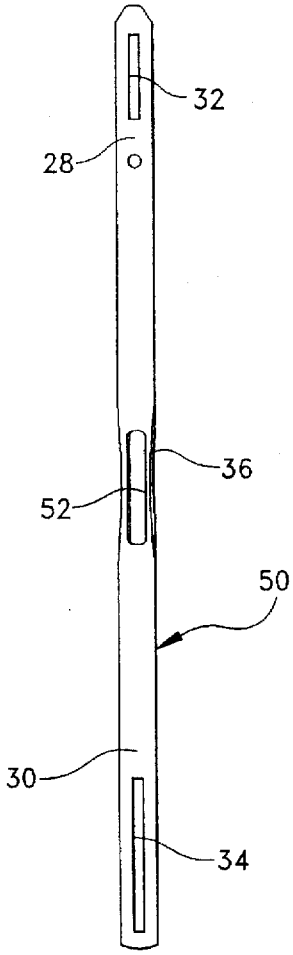
FIG. 7 is a front elevational view thereof.
Figure 8:
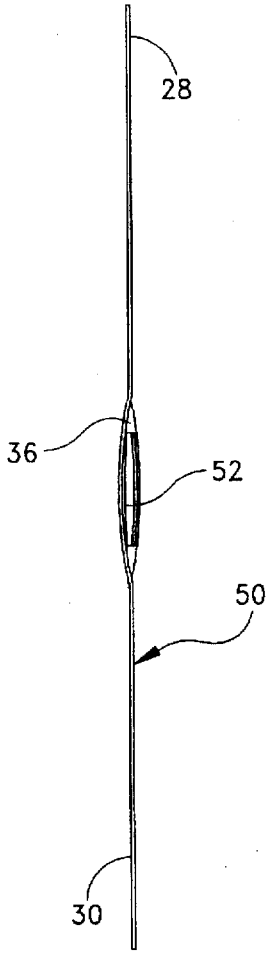
FIG. 8 is a side elevational view thereof.

Prior to the present invention, each harness 24 would be provided with a plurality of vertically disposed heddles, each generally indicated at 26, that are illustrated in FIGS. 3 through 5. Each heddle 26 is suitably connected in the well-known manner at its upper and lower end portions 28, 30 to the harness 24 (e.g., via openings or slots 32, 34 formed therein, respectively) and has a middle portion 36 that is twisted relative to the planes of the upper and lower end portions 28, 30. This middle portion 36 has a generally square-shaped, relatively small opening 38 formed therein, through which a warp yarn 20 is threaded.

Figure 11:
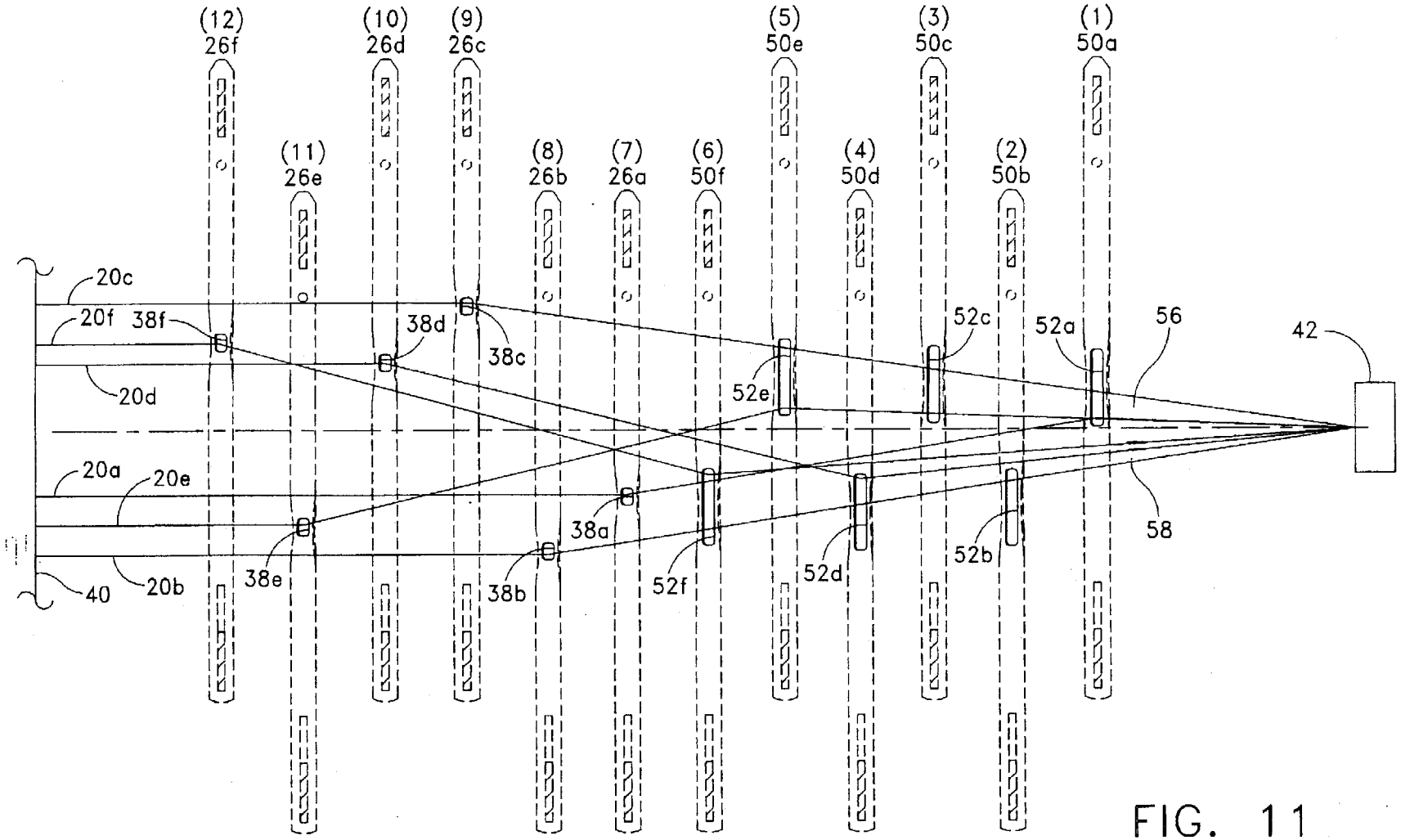
FIG. 11 is a schematic elevational view of the twelve heddles in the first position (pick no. 1) depicted in FIG. 10.
Figure 12:
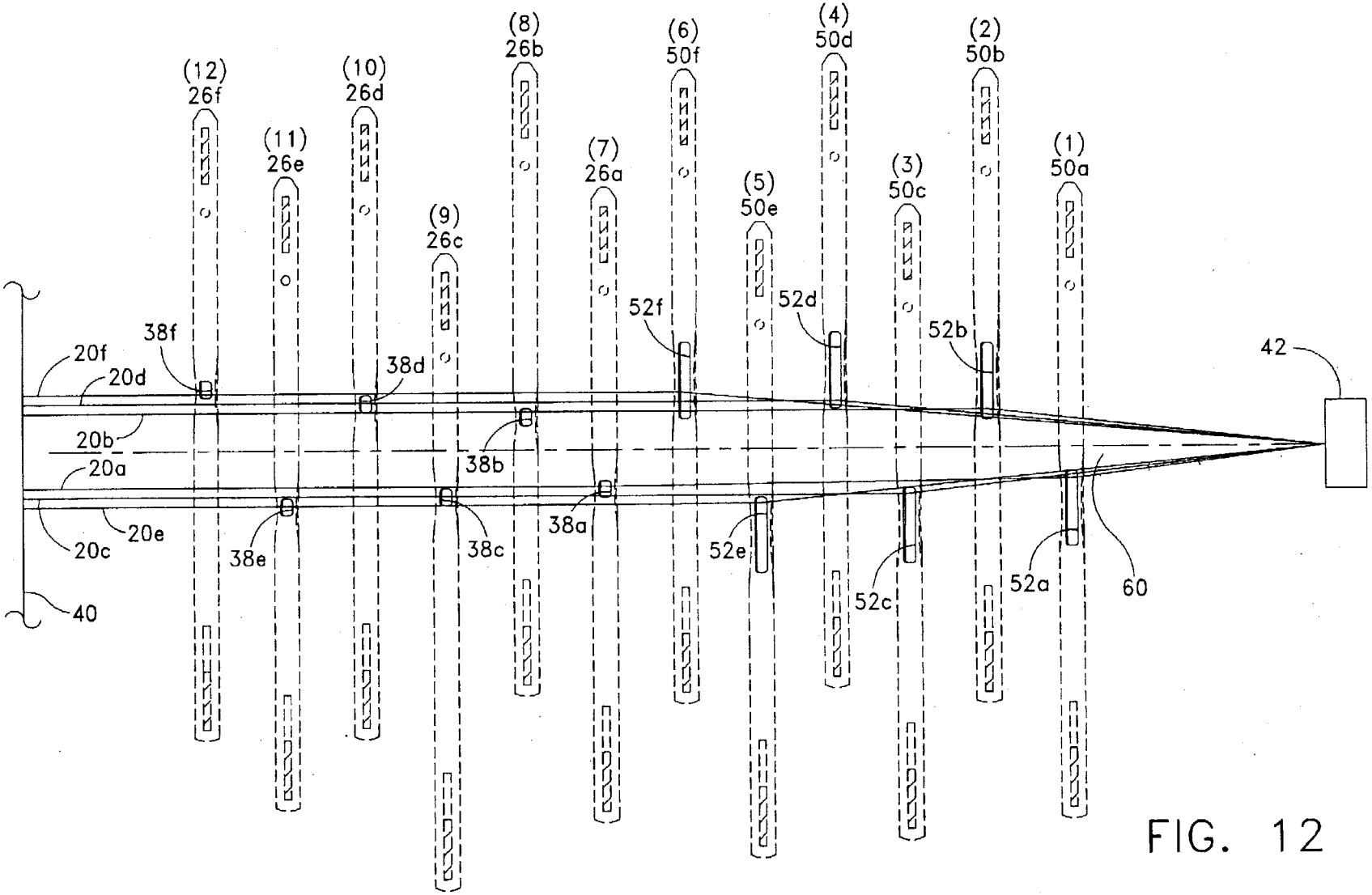
FIG. 12 is a schematic elevational view of the twelve heddles in the seventh or eighth position (pick nos. 7 or 8) depicted in FIG. 10.

The needle loom machine further includes suitable means for delivering warp yarns 20 to the heddles of the harnesses from spools carrying yarns (not shown), and for maintaining tension on the warp yarns 20 and taking up woven material. Reference is made to FIGS. 11 and 12 which schematically illustrate the delivering and tensioning mechanisms 40, 42 of the needle loom machine. The arrangement is such that the harnesses 24, delivering mechanism 40, and tensioning mechanism 42, prior to the modifications discussed below, are adapted to position the warp yarns 20, which each extend through one of the heddles 26 of one of the harnesses 24, in such a position that there is a single shed opening formed by the warp yarns through which weft yarns are woven by a pair of needles of the machine.

Thus, unlike a double shuttle loom, the needle loom machine cannot move its harnesses 24 between three positions (top, middle and bottom) but is limited to only two positions (top and bottom). This means that the warp yarns 20 are positioned to create a top layer of yarns and a bottom layer of yarns. As briefly mentioned above, the opening between the top and bottom layers of yarns is called a shed opening. Until the present invention, needle loom machines, due to their inability to move the harnesses in three positions (as compared to double shuttle looms) and thereby create two shed openings, could only create one shed opening to produce solid webbing or two separate solid webbings.

Since needle loom machines are so well-known in the art, no further description of the machine itself will be set forth. The set-up configurations represented by the charts identified in FIGS. 10 and 13 are believed to contain adequate information for a person having familiarity with a needle loom machine to set it up and produce the cargo webbing 10 illustrated in FIGS. 1 and 2.

Turning now to FIGS. 6 through 9, there is generally illustrated at 50 a modified heddle of the present invention. This heddle 50 is identically constructed as the heddle 26 illustrated in FIGS. 3 through 5, except for the provision of an elongate slot 52 formed in the middle portion 36 of the heddle 50 that replaces opening 38 of heddle 26. The purpose of the slot 52 will become apparent as the detailed description proceeds. Otherwise, the heddle 50 is the same as heddle 26, and identical parts are referenced with the same reference numerals used to describe heddle 26.

Figure 9:
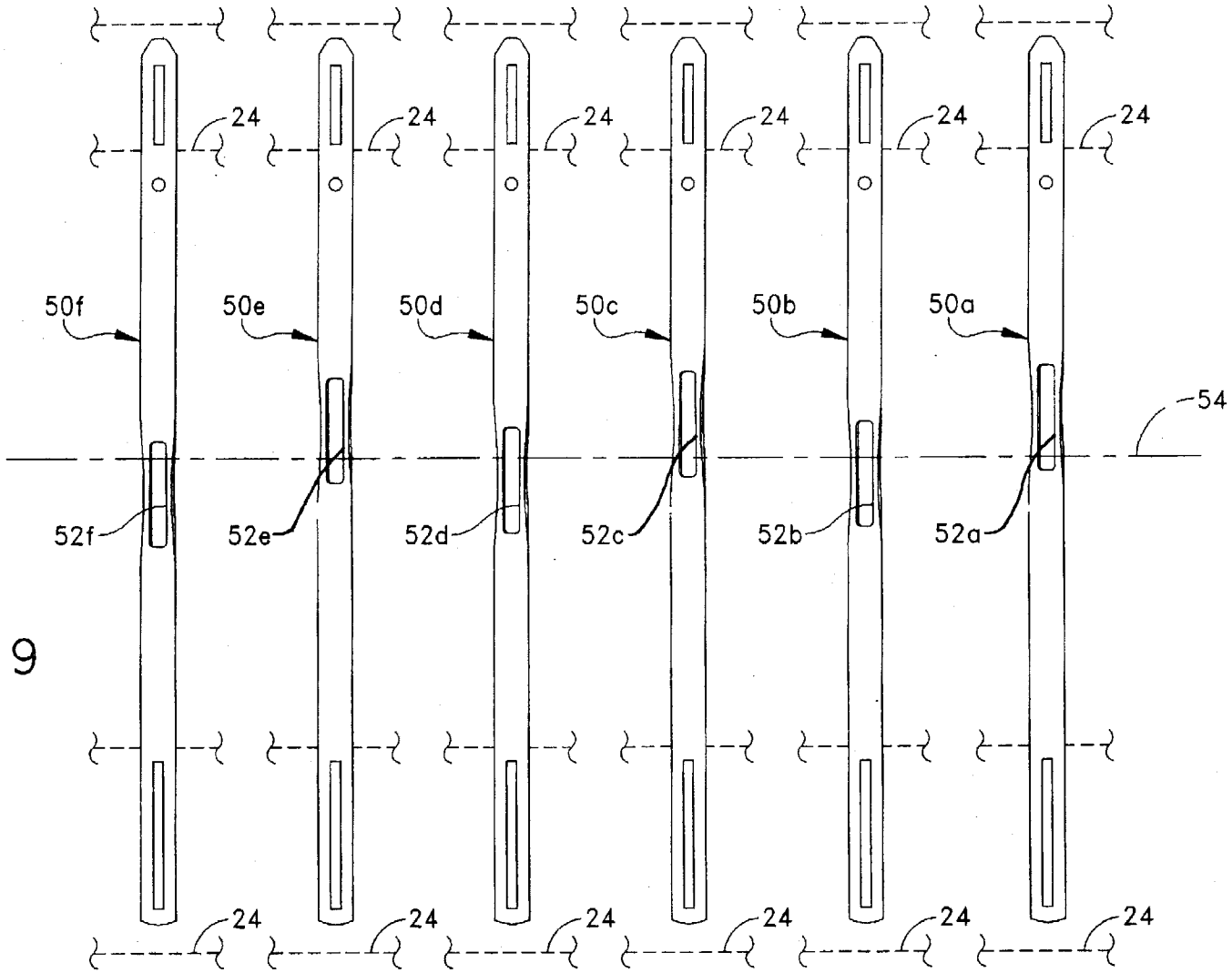
FIG. 9 is a schematic elevational view of six modified heddles used to manufacture the cargo webbing illustrated in FIG. 1.

Turning particularly to FIG. 9, there are six heddles **50*a* through 50*f* that each include the slots 52, each of the slots being vertically positioned at a predetermined height with respect to a centerline 54 of the needle loom machine. As shown, the slots 52*a*, 52*c* and 52*e* of heddles 50*a*, 50*c* and 50*e*, respectively, are positioned above the centerline 54, and the slots 52*b*, 52*d* and 52*f* of heddles 50*b*, 50*d* and 50*f*, respectively, are positioned below the centerline 54. Moreover, although the slots 52*a* through 52*f* appear to be identical in length, heddle 50*a* has a slot length of 0.750 inch with its centerline being located 0.150 inch above the centerline 54, heddle 50*b* has a slot length of 0.750 inch with its centerline being located 0.150 inch below the centerline 54, heddle 50*c* has a slog length of 0.875 inch with its centerline being located 0.187 inch above the centerline 54, heddle 50*d* has a slot length of 0.812 inch with its centerline being located 0.125 inch below the centerline 54, heddle 50*e* has a slot length of 0.937 inch with its centerline being located 0.165 inch above the centerline 54, and heddle 50*f* has a slot length of 0.900 inch with its centerline being located 0.115 inch below the centerline 54. The location and length of the slots 52*a* through 52*f* of heddles 50*a* through 50*f*, respectively, depend on the type of fabric being woven. The heddle 50 illustrated in FIGS. 6 through 9 is specifically designed for creating cargo webbing pursuant to the pattern of operation depicted in FIG. 10**.

Referring to FIG. 10, there is illustrated a chart by which the needle loom machine is programmed to produce cargo webbing similar to cargo webbing 10. Heddles **50*a*, 50*b*, 50*c*, 50*d*, 50*e* and 50*f* correspond to heddles 1 through 6 of the chart illustrated in FIG. 10. This group of heddles constitutes a first group of heddles that are positioned generally adjacent the tensioning mechanism 42. Heddles 7 through 12 in FIG. 10 are chosen from standard heddles such as the heddle 26 illustrated in FIGS. 3 through 5. This group of heddles constitutes a second group of heddles that are positioned generally adjacent the warp yarn delivering mechanism 40. For this configuration, there are six warp yarns 20, one warp yarn 20*a* extending through heddles 50*a* (1) and 26*a* (7), one warp yarn 20*b* extending though the heddles 50*b* (2) and 26*b* (8), one warp yarn 20*c* extending through heddles 50*c* (3) and 26*c* (9), one warp yarn 20*d* extending through heddles 50*d* (4) and 26*d* (10), one warp yarn 20e extending through heddles 50e (5) and 26e (11), and one warp yarn 20f extending through heddles 50f (6) and 26f** (12).

Stated another way, the heddle 50a of the harness 24 of the first group of harnesses closest to the tensioning mechanism 42 is paired with the heddle 26a of the harness 24 of the second group closest to the tensioning mechanism 42, and so on. The heddles 50a through 50f closest to the tensioning mechanism 42, i.e., heddles 1 through 6 in FIG. 10, have the slots 52a through 52f, respectively, for artificially creating two shed openings which will be described in greater detail below. Thus, unlike the set-up for a standard weave pattern, the heddles 26 of the first group of the needle loom machine are replaced with the modified heddles 50. The heddles 26 closest to the yarn delivering mechanism 40, i.e., heddles 7 through 12 in FIG. 10, are chosen from the commercially available heddles.

For pick no. 1 of FIG. 10, heddles 50a (1), 50c (3), 50e (5), 26c (9), 26d (10) and 26f (12) are in the up position via their respective harnesses 24, and heddles 50b (2), 50d (4), 50f (6), 26a (7), 26b (8) and 26e (11) are in the down position. This configuration results in yarns 20a, 20c and 20e forming one shed opening 56 and yarns 20b, 20d and 20f forming a second shed opening 58. It should be pointed out that the movement of the harnesses 24 between their up and down positions is programmed into a central processing unit of the needle loom machine. As shown, there is illustrated a small opening between the first and second shed openings 56, 58 that is not utilized. This small opening can be completely eliminated by varying the slot sizes and the length of harness movements.

More specifically, in this configuration, the harnesses 24 having heddles 50a (1) and 50b (2) are programmed to move 1.2 inches with respect to the centerline 54, the harnesses having heddles 50c (3) and 50d (4) are programmed to move 1.372 inches, the harnesses having heddles 50e (5) and 50f (6) are programmed to move 1.544 inches, the harnesses having heddles 26a (7) and 26b (8) are programmed to move 1.716 inches, the harnesses having heddles 26c (9) and 26d (10) are programmed to move 1.888 inches, and the harnesses having heddles 26e (11) and 26f (12) are programmed to move 2.061 inches.

In the pick no. 1 position, an upper needle (not shown) of the needle loom machine weaves a weft yarn 22 through the first or top shed opening 56 and a lower needle (not shown) weaves a weft yarn 22 through the second or bottom shed opening 58. Thus, when in this general configuration, the slotted portion 14 of the cargo webbing 10 is being fabricated. Referencing FIG. 10, this pattern continues until heddles 50a (1), 50f (6), 26a (7) and 26f (12) reach pick no. 6, heddles 50d (4), 50e (5), 26d (10) and 26e (11) reach pick no. 5, and heddles 50b (2), 50c (3), 26b (8) and 26c (9) reach pick no. 4. Upon the heddles 50, 26 reaching these picks, the fabrication of the slotted portion 14 ceases and the fabrication of the solid portion 12 begins. The pick numbers for each heddle, when fabricating the solid portion 12, are illustrated in FIG. 10 with horizontal darkened lines. As shown, for each heddle, the solid portion 12 of the cargo webbing 10 runs for four picks.

Turning now to FIGS. 10 and 12, for pick nos. 7 and 8, which are identical, heddles 50b (2), 50d (4), 50f (6), 26b (8), 26d (10) and 26f (12) are in the up position via their respective harnesses 24 and heddles 50a (1), 50c (3), 50e (5), 26a (7), 26c (9) and 26e (11) are in the down position. This configuration results in yarns 20b, 20d and 20f being elevated with respect to yarns 20a, 20c and 20e thereby forming one shed opening 60. In this position, the upper and lower needles of the needle loom machine weaves weft yarns 22 through the shed opening 60 for fabricating the solid portion 12 of the cargo webbing. Referencing FIG. 10, this pattern continues until heddles 50a (1), 50f (6), 26a (7) and 26f (12) reach pick no. 11, heddles 50d (4), 50e (5), 26d (10) and 26e (11) reach pick no. 10, and heddles 50b (2), 50c (3), 26b (8) and 26c (9) reach pick no. 9. Upon the heddles 50, 26 reaching these picks, the fabrication of the solid portion 12 ceases and the fabrication of the slotted portion 14 begins.

Referring back to FIG. 11, it illustrates how the warp yarns 20a through 20f are configured so as to achieve two shed openings 56, 58. As shown, yarns 20a and 20e are positioned in the bottom of the slots 52a, 52e of their respective heddles 50a, 50e so as to form the middle layer of yarn that is matched with the yarn 20c that extends through heddles 26c and 50c for forming the first shed opening 56. Similarly, yarns 20d and 20f are positioned in the top of the slots 52d and 52f of their respective heddles 50d and 50f so as to form the middle layer of yarn that is matched with the yarn 20b that extends through heddles 26b, 50b for forming the second shed opening 58. It is the slots 52 formed in the heddles 50 that enables the slotted portion 14 of the cargo webbing 10 to be fabricated since the warp yarns 20 that extend therethrough can be manipulated to extend in a plane generally adjacent the centerline 54 or spaced therefrom.

It should be pointed out that for illustration purposes only six warp yarns are illustrated in FIGS. 11 and 12. During the actual fabrication of cargo webbing 10, additional warp yarns may be provided depending upon the width of webbing desired. Thus, these additional warp yarns would be configured to extend between two heddles 26, 50 in the manner described above in order to achieve the shed openings 56, 58 and 60 illustrated in FIGS. 11 and 12.

FIG. 13 illustrates a pattern of another preferred embodiment. This pattern is designed to produce cargo webbing having a different design than the pattern embodied in FIG. 10. It should be observed that there are any number of patterns that can be used to fabricate cargo webbing, each of which falls under the scope of the present invention.

The method of the present invention is as follows. First, warp yarns 20 are selectively positioned by the needle loom machine between a first position in which there is a single shed opening 60 provided through the yarns 20 and a second position in which there are two shed openings 56, 58 provided through the yarns 20. Weft yarns 22 are then inserted by needles of the needle loom machine through the shed openings. The arrangement is such that when the warp yarns 20 are in their first position, the solid portion 12 of the webbing 10 is fabricated and when the warp arms 20 are in their second position, the slotted portion 14 of the webbing 10 is fabricated. It is the modified heddles 50 that enable the needle loom machine to weave cargo webbing 10. More particularly, the modified heddles 50 enables the formation of two shed openings. This results in the production of cargo webbing 10 at an increased rate of speed as compared to the fabrication of such webbing with a shuttle loom.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A method of manufacturing slotted webbing of the type having slotted portions and solid portions, said method comprising the steps of:

(a) providing a needle loom machine including at least two different heddle types;

(b) selectively positioning warp yarns with said needle loom machine between a first position associated with the first heddle type in which there is a single shed opening provided through the yarns and a second position associated with the second heddle type in which there are two shed openings provided through the yarns;

(c) inserting weft yarns with said needle loom machine through the shed openings to weave the warp yarns with the weft yarns;

(d) weaving the solid portion of the webbing when the warp yarns are in their first position; and (e) weaving the slotted portion of the webbing when the warp yarns are in their second position.

2. A method as set forth in claim 1 further comprising the steps of:

providing a plurality of harnesses for the at least two different heddle types each being movable between up and down positions, each harness having at least one vertically disposed heddle mounted thereon with a small, central opening formed therein, said warp yarns of the webbing being received through openings of the heddles; and inserting the warp yarns of the webbing through said openings of the heddles of the harnesses.

3. A method as set forth in claim 2 further comprising the step of dividing the plurality of harnesses into two equal first and second groups, the harnesses of the first group having said heddles with the small central opening therein and the harnesses of the second group having heddles each with a vertical slotted opening formed therein.

4. A method as set forth in claim 3 further comprising the step of pairing the harness of the first group of harnesses closest to the point of weaving with the harness of the second group each associated with one of said at least two different heddle types closest to the first group.

5. In a needle loom machine capable of manufacturing solid webbing comprising:

a plurality of harnesses, each harness being adapted to be movable between up and down positions and having at least one vertically disposed heddle mounted thereon, the heddle being attached to its respective harness at opposite end thereof and having a small opening formed therein for receiving a warp yarn of material therethrough;

delivering means for delivering warp yarns to the heddles of the harnesses;

tensioning means for maintaining tension on the warp yarns and for taking up woven material, the harnesses, delivering means and tensioning means positioning warp yarns in a position that there is a single shed opening provided through the warp yarns; and a pair of needles each having a weft yarn, said needles entering the shed opening for weaving weft yarns with the warp yarns;

wherein the improvement comprises two equal groups of harnesses, a first group being positioned adjacent the tensioning means and a second group being positioned adjacent the delivering means, the harness of the first group closest to the tensioning means being paired with the harness of the second group closest to the tensioning means, and the heddles of the harnesses of the first group having vertically oriented, elongated slotted openings formed therein for selectively positioning the warp yarns between a first position in which there is a single shed opening provided through the yarns and a second position in which there are two shed openings provided through the yarns, wherein, when said weft yarns are inserted with said needles when the warp yarns are in their first position, solid webbing is fabricated and when the warp arms are in their second position, slotted webbing is fabricated.

6. In combination with a needle loom machine a heddle comprising an elongate body having an upper end portion, a lower end portion, and a middle portion disposed therebetween, said upper and lower portions having means for attaching the heddle to a harness of the needle loom machine, said middle portion of the heddle having an elongate slot formed therein, said elongate slot being vertically positioned at a predetermined height from the lower end portion.

* * * * *